United States Patent [19]

Chang et al.

[11] Patent Number: 4,904,762

[45] Date of Patent: Feb. 27, 1990

[54] TONER COMPOSITIONS WITH CHARGE ENHANCING ADDITIVES

[75] Inventors: Hui Chang, Pittsford; John R. Laing, Rochester; Maria E. McCall, Penfield, all of N.Y.

[73] Assignee: Xerox Corporation, Stamford, Conn.

[21] Appl. No.: 396,510

[22] Filed: Aug. 21, 1989

[51] Int. Cl.[4] ..... G03G 9/10

[52] U.S. Cl. ..... 430/110; 430/109

[58] Field of Search ..... 430/110

[56] References Cited

U.S. PATENT DOCUMENTS

| | | | |
|---|---|---|---|
| Re. 32,883 | 3/1989 | Lu | 430/110 |
| 3,893,935 | 7/1975 | Jadwin et al. | 252/62.1 |
| 4,152,276 | 5/1979 | Jackisuh | 252/51.5 A |
| 4,221,856 | 9/1980 | Lu | 430/110 |
| 4,291,111 | 9/1981 | Lu | 430/107 |
| 4,291,112 | 9/1981 | Lu | 430/110 |
| 4,298,672 | 11/1981 | Lu | 430/108 |
| 4,299,903 | 12/1985 | Hoffend et al. | 430/106.6 |
| 4,312,933 | 1/1982 | Lu | 430/122 |
| 4,394,430 | 7/1983 | Jadwin et al. | 430/110 |
| 4,542,216 | 9/1985 | Pfluger | 544/320 |
| 4,547,216 | 10/1985 | Bohner | 71/93 |
| 4,560,635 | 12/1985 | Hoffend et al. | 430/106.6 |
| 4,604,338 | 8/1986 | Gruber et al. | 430/106 |
| 4,752,550 | 6/1988 | Barbetta et al. | 430/106.6 |
| 4,792,513 | 12/1988 | Gruber et al. | 430/110 |
| 4,810,611 | 3/1989 | Ziolo et al. | 430/106.6 |
| 4,820,604 | 4/1989 | Manca et al. | 430/110 |
| 4,824,750 | 4/1989 | Mahalek et al. | 430/99 |
| 4,828,956 | 5/1989 | Cretura et al. | 430/137 |
| 4,837,105 | 6/1989 | Manca et al. | 430/126 |
| 4,859,550 | 8/1989 | Gruber et al. | 430/39 |

FOREIGN PATENT DOCUMENTS

| | | | |
|---|---|---|---|
| 3068848 | 3/1988 | Japan | 430/110 |

OTHER PUBLICATIONS

Phase Transfer Catalysis, Principles and Techniques, Academic Press, NY, 1978, C. M. Starks and C. Liotta, p. 76.

"Preparative Ion Pair Extraction", Apotcharsocieteten/Hassle, Lakemidel, Sweden, 1974, pp. 139 to 148, copy not available at this time.

*Primary Examiner*—Paul R. Michl
*Assistant Examiner*—Stephen C. Crossan
*Attorney, Agent, or Firm*—E. O. Palazzo

[57] ABSTRACT

A toner composition comprised of resin, pigment, and a mixture of charge enhancing additives comprised of a first additive of distearyl dimethyl ammonium methyl sulfate, and a second additive comprised of a tetraalkyl ammonium bisulfate.

42 Claims, No Drawings

TONER COMPOSITIONS WITH CHARGE ENHANCING ADDITIVES

BACKGROUND OF THE INVENTION

The invention is generally directed to toner and developer compositions, and more specifically, the present invention is directed to developer and toner compositions containing therein a mixture of charge enhancing additives, which impart, or assist in imparting a positive charge to the toner resin particles and enable toners with rapid admix characteristics. In one embodiment, there are provided in accordance with the present invention toner compositions comprised of resin particles, pigment particles, and a mixture of certain charge enhancing additives enabling, for example, rapid admix of less than about 15 seconds in some embodiments, extended developer life, stable electrical properties, and compatibility with fuser rolls including Viton fuser rolls. The aforementioned toner compositions usually contain pigment particles comprised of, for example, carbon black, magnetites, cyan, magenta, yellow, blue, green, red, or brown components, thereby providing for the development of black or colored images. The toner compositions of the present invention possess excellent admix characteristics as indicated herein, and maintain their triboelectric charges for an extended number of imaging cycles exceeding, for example, 500,000. Also, the toner and developer compositions of the present invention can be selected for electrophotographic, especially xerographic, imaging and printing processes including color processes.

Developer compositions with charge enhancing additives, which impart a positive charge to the toner resin, are well known. Thus, for example, there is described in U.S. Pat. No. 3,893,935 the use of quaternary ammonium salts $R_4N$ as charge control agents for electrostatic toner compositions. There is also described in U.S. Pat. No. 2,986,521 reversal developer compositions comprised of toner resin particles coated with finely divided colloidal silica. According to the disclosure of this patent, the development of electrostatic latent images on negatively charged surfaces is accomplished by applying a developer composition having a positively charged triboelectric relationship with respect to the colloidal silica.

Also, there are disclosed in U.S. Pat. No. 4,338,390, the disclosure of which is totally incorporated herein by reference, developer compositions containing as charge enhancing additives organic sulfate and sulfonates, which additives can impart a positive charge to the toner composition. Further, there are disclosed in U.S. Pat. No. 4,298,672 positively charged toner compositions with resin particles and pigment particles, and as charge enhancing additives alkyl pyridinium compounds. Additionally, other documents disclosing positively charged toner compositions with charge control additives include U.S. Pat. Nos. 3,944,493; 4,007,293; 4,079,014; 4,394,430 and 4,560,635.

Compositions with inner salt charge enhancing additives are illustrated in U.S. Pat. No. 4,752,550, the disclosure of which is totally incorporated herein by reference. It is indicated in column 3, beginning at line 57, that one of the objects of the invention of the '550 patent resides in providing toner compositions containing mixtures of inner salt charge enhancing additives and other known charge enhancing additives. Examples of mixtures of charge enhancing additives are illustrated in column 4, beginning at line 1, and include mixtures of the inner salts with, for example, distearyl dimethyl ammonium methyl sulfate, reference U.S. Pat. No. 4,560,635; organic sulfate and sulfonate compositions inclusive of stearyl phenethyl dimethyl ammonium tosylates, reference U.S. Pat. No. 4,338,390; and alkyl pyridinium chlorides including cetyl pyridinium chloride, reference U.S. Pat. No. 4,298,672. Advantages of the toner and developers of the '550 patent, particularly when they include therein one additive such as the inner salts, see column 9, and note the working Examples, include rapid admix, that is the toner compositions will acquire a positive charge in a period of from about 5 seconds to about 1 minute, see column 9, beginning at line 17; compatibilty with Viton fuser rolls; are lower fusing temperatures, that is from about 20° F. to about 40° F. than is achievable for toners and developers having incorporated therein some of the charge enhancing additives of the prior art, including quaternary ammonium salts.

As a result of a patentability search, there were located U.S. Pat. Nos. 4,560,635; 4,604,338 and 4,792,513, which patents illustrate toners with charge enhancing additives.

Moreover, toner compositions with negative charge enhancing additives are known, reference for example U.S. Pat. Nos. 4,411,974 and 4,206,064, the disclosures of which are totally incorporated herein by reference. The '974 patent discloses negatively charged toner compositions comprised of resin particles, pigment particles, and as a charge enhancing additive ortho-halo phenyl carboxylic acids. Similarly, there are disclosed in the '064 patent toner compositions with chromium, cobalt, and nickel complexes of salicylic acid as negative charge enhancing additives.

There is illustrated in U.S. Pat. No. 4,404,271 a complex system for developing electrostatic images with a toner which contains a metal complex represented by the formula in column 2, for example, and wherein ME can be chromium, cobalt or iron. Additionally, other patents disclosing various metal containing azo dyestuff structures wherein the metal is chromium or cobalt include 2,891,939; 2,871,233; 2,891,938; 2,933,489; 4,053,462 and 4,314,937. Also, in U.S. Pat. No. 4,433,040, the disclosure of which is totally incorporated herein by reference, there are illustrated toner compositions with chromium and cobalt complexes of azo dyes as negative charge enhancing additives.

Other prior art includes Japanese Publication No. 54-145542 which illustrates a negatively chargeable toner consisting of a resin, a colorant, and the charge control agent pyridoxine aliphatic acid ester; East German Patent Publication 218697 relating to liquid developers with charge control additives with structural units of Formulas (I), (II) and (III), and which contains olefinically polymerizable bonds; U.S. Pat. No. 3,850,642 relating to multilayer sensitive elements with ionizable salts, acids, esters, and surfactants as charge control agents; 2,970,802 illustrating a composition for the control of hypercholestermia, which composition consists of a nontoxic gelatin containing aluminum nicotinate; and 3,072,659 which discloses a method of preparing aluminum salts of nicotinic acid.

Although toners with charge enhancing additives are known, there continues to be a need for toners which possess many of the advantages illustrated herein. Additionally, there is a need for positive charge enhancing additives which are useful for incorporation into black or colored toner compositions. Moreover, there is a need for color toner applications with certain charge enhancing additives. There is also a need for toner compositions containing certain mixtures of charge enhancing additives, which toners possess acceptable triboelectric charging characteristics, and excellent admixing properties. Moreover, there continues to be a need for humidity insensitive positively charged toner and developer compositions. Further, there is a need for toners with a mixture of charge enhancing additives which can be easily and permanently dispersed into toner resin particles. There also is a need for positively charged black and colored toner compositions that are useful for incorporation into various imaging processes, inclusive of color xerography, as illustrated in U.S. Pat. No. 4,078,929, the disclosure of which is totally incorporated herein by reference; laser printers; and additionally, the toner compositions of the present invention are useful in imaging apparatuses having incorporated therein layered photoresponsive imaging members, such as the members illustrated in U.S. Pat. No. 4,265,990, the disclosure of which is totally incorporated herein by reference. Furthermore, there is a need for toner compositions whose triboelectric charging characteristics and admixing properties can be adjusted independently. Furthermore, there is a need for toner compositions which possess a triboelectric charge level of from about 10 to about 40 microcoulombs per gram, and preferably from about 10 to about 20 microcoulombs per gram, and admix charging times of from about 5 to 60 seconds, and preferably less than 15 seconds, as determined by a charge spectrograph, especially at low concentrations, for example less than 1 percent, and preferably less than 0.5 percent of charge enhancing additives.

SUMMARY OF THE INVENTION

It is an object of the present invention to provide toner and developer compositions with charge enhancing additives.

In another object of the present invention there are provided positively charged toner compositions useful for the development of electrostatic latent images including color images.

In yet another object of the present invention there are provided positively charged toner compositions containing a certain mixture of charge enhancing additives, which additives can be selected in low concentrations as indicated herein.

Also, in another object of the present invention there are provided developer compositions with positively charged toner particles, carrier particles, and a mixture of charge enhancing additives.

In yet a further object of the present invention there are provided humidity insensitive positively charged toner compositions with desirable admix charging properties of 5 seconds to 60 seconds as determined by the charge spectrograph, and preferably less than 15 seconds for example, and acceptable stable triboelectric charging characteristics of from about 10 to about 40 microcoulombs per gram.

Additionally, in a further object of the present invention there are provided positively charged magnetic toner compositions, and positively charged colored toner compositions containing therein, or thereon a mixture of certain charge enhancing additives, and wherein these compositions possess excellent shelt life stability.

Furthermore, in yet another object of the present invention there are provided toner compositions with a mixture of charge enhancing additives, which compositions are useful in a variety of electrostatic imaging and printing processes, including color xerography.

Another object of the present invention resides in the formation of toners which will enable the development of images in electrophotographic imaging apparatuses, which images have substantially no background deposits thereon, are substantially smudge proof, or smudge resistant, and therefore are of excellent resolution; and further, such toner compositions can be selected for high speed electrophotographic apparatuses, that is those exceeding 70 copies per minute.

These and other objects of the present invention are accomplished by providing toner compositions comprised of resin particles, pigment particles, and a mixture of charge enhancing additives. More specifically, the present invention is directed to toner compositions comprised of resin, pigment, or mixtures thereof, in some instances dye, a first charge enhancing additive of a quaternary ammonium salt, and preferably distearyl dimethyl ammonium methyl sulfate, reference U.S. Pat. No. 4,560,635, the disclosure of which is totally incorporated herein by reference, and a second charge enhancing additive comprised of an alkyl ammonium bisulfate, wherein alkyl contains from 1 to about 20, and preferably from 1 to about 10 carbon atoms, such as distearyl dimethyl ammonium bisulfate, tetramethyl ammonium bisulfate, tetraethyl ammonium bisulfate, tetrabutyl ammonium bisulfate, and the like. The aforementioned charge additives can be incorporated in effective amounts into the toner or may be present on the toner surface. While not being desired to be limited to theory, it is believed that the first additive functions primarily as the charge control component, and the second additive functions primarily as the admix charge component.

Specific examples of first charge enhancing additives selected for the toner compositions of the present invention in addition generally to the quaternary ammonium salts include those as illustrated herein with distearyl dimethyl ammonium methyl sulfate being preferred. The aforementioned first additive is present in various effective amounts depending on the amounts of the other components, for example. Preferably, the first additive is present in an amount of from about 0.05 to about 3 and more preferably about 0.1 to about 0.5 weight percent. Other effective amounts of first additive may be selected.

Specific examples of second charge enhancing additives selected for the toner compositions of the present invention include alkyl ammonium bisulfates, such as distearyl dimethyl ammonium bisulfate, tetramethyl ammonium bisulfate, or tetraalkyl ammonium bisulfates ($HSO_4$), reference copending applications U.S. Ser. No. 396509 filed 8-21-89, entitled "Toner and Developer Compositions With Charge Enhancing Additives", and U.S. Ser. No. 396497 filed 8-21-89, entitled "Quaternary Ammonium Compounds and Processes Thereof", the disclosures of each of these applications being totally incorporated herein by reference, tetraethyl ammonium bisulfate, tetrabutyl ammonium bisulfate, and the like. The second additive is present in various effective amounts depending on the amounts of the other components, for example. Preferably, the second additive is present in an amount of from about 0.05 to about 2 and more preferably 0.1 to 0.3 weight percent. Other amounts of second additive can be selected especially if the objectives of rapid admix and appropriate triboelectric characteristics are achieved.

The charge additive mixtures can be present in the toner or on the surface thereof. For example, the toner compositions of the present invention can be prepared by melt mixing resin, pigment, and the first and second charge additive; melt mixing the toner resin, pigment, and the first additive, followed by external blending of the second additive; or melt mixing the toner resin, pigment, and the second additive followed by external blending of the first additive.

In one specific embodiment, the process of the present invention comprises the preparation of toner compositions by admixing and heating resin particles such as styrene butadiene copolymers, pigment particles such as magnetite, carbon black, or mixtures thereof, and an effective amount, preferably from about 0.1 percent to about 3 percent, however, up to 10 and about 0.05 of the mixture may be selected in some instances, of a mixture of two charge enhancing additives in a toner extrusion device and removing the formed toner composition from the device. Subsequent to cooling, the toner composition is subjected to grinding utilizing, for example, a Sturtevant micronizer for the purpose of achieving toner particle sizes, that is toner particle sizes with a volume median diameter of less than about 20 microns, and preferably of from about 8 to about 12 microns, which diameters are determined by a Coulter Counter. Subsequently, the toner compositions are classified utilizing, for example, a Donaldson Model B classifier for the purpose of removing fines, that is toner particles less than about 4 microns volume median diameter.

Illustrative examples of suitable toner resins selected for the toner and developer compositions of the present invention include polyamides, styrene acrylates, styrene methacrylates, styrene butadienes, including Pliolites, other resins as illustrated in U.S. Pat. No. 4,752,550, the disclosure of which is totally incorporated herein by reference, polyolefins, epoxies, polyurethanes, vinyl resins, including homopolymers or copolymers of two or more vinyl monomers, and polymeric esterification products of a dicarboxylic acid and a diol comprising a diphenol. Vinyl monomers include styrene, p-chlorostyrene, unsaturated mono-olefins such as ethylene, propylene, butylene, isobutylene and the like; saturated mono-olefins such as vinyl acetate, vinyl propionate, and vinyl butyrate; vinyl esters like esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; styrene butadiene copolymers; and mixtures thereof.

As one preferred toner resin, there is elected the esterification products of a dicarboxylic acid and a diol comprising a diphenol. These resins are illustrated in U.S. Pat. No. 3,590,000, the disclosure of which is totally incorporated herein by reference. Other preferred toner resins include styrene/methacrylate copolymers, and styrene/butadiene copolymers; Pliolites; suspension polymerized styrene butadienes, reference U.S. Pat. No. 4,558,108, the disclosure of which is totally incorporated herein by reference; polyester resins obtained from the reaction of bisphenol A and propylene oxide, followed by the reaction of the resulting product with fumaric acid; and branched polyester resins resulting from the reaction of dimethylterephthalate, 1,3-butanediol, 1,2-propanediol, pentaerythritol, and styrene acrylates; and mixtures thereof. Also, waxes with a molecular weight of from about 1,000 to about 6,000 such as polyethylene, polypropylene, and paraffin waxes can be present in the toner compositions as fuser roll release agents.

The resin particles are present in a sufficient, but effective amount, for example from about 70 to about 90 weight percent. Thus, when 1 percent by weight of the charge enhancing additive mixture is present, and 10 percent by weight of pigment or colorant such as carbon black is contained therein, about 89 percent by weight of resin is selected. Also, the charge enhancing additive mixture of the present invention may be coated on the pigment particles especially if the main objectives of the present invention are achieved. When used as a coating, the charge enhancing additive mixture of the present invention is present in an amount of from about 0.1 weight percent to about 5 weight percent, and preferably from about 0.3 weight percent to about 1 weight percent.

Numerous well known suitable pigments or dyes can be selected as the colorant for the toner particles including, for example, carbon black, nigrosine dye, aniline blue, magnetite, and mixtures thereof. The pigment, which is preferably carbon black, is present in a sufficient amount to render the toner composition highly colored. Generally, the pigment particles are present in amounts of from about 3 percent by weight to about 20 percent by weight, and preferably from about 5 to about 10 weight percent based on the total weight of the toner composition; however, lesser or greater amounts of pigment particles may be selected.

When the pigment particles are comprised of magnetites, thereby enabling single component toners in some instances, which magnetites are a mixture of iron oxides ($FeO.Fe_2O_3$) including those commercially available as Mapico Black, they are present in the toner composition in an amount of from about 10 percent by weight to about 70 percent by weight, and preferably in an amount of from about 10 percent by weight to about 50 percent by weight.

There can also be blended into the toner compositions of the present invention external additive particles including flow aid additives, which additives are usually present on the surface thereof. Examples of these additives include colloidal silicas such as Aerosil, metal salts and metal salts of fatty acids inclusive of zinc stearate; aluminum oxides, cerium oxides, and mixtures thereof, which additives are generally present in an amount of from about 0.1 percent by weight to about 5 percent by weight, and preferably in an amount of from about 0.1 percent by weight to about 1 percent by weight. Several of the aforementioned additives are illustrated in U.S. Pat. Nos. 3,590,000; 3,655,374; 3,720,617; 3,923,503 and 3,800,588, the disclosures of which are totally incorporated herein by reference.

With further respect to the present invention, colloidal silicas such as Aerosil can be surface treated with the charge additive mixtures illustrated herein in an amount of from about 1 to about 30 weight percent, and preferably 10 weight percent followed by the addition thereof to the toner in an amount of from about 0.1 to about 10 and, preferably from about 0.1 to about 1 weight percent.

Also, there can be included in the toner compositions of the present invention low molecular weight waxes, such as polypropylenes and polyethylenes, commercially available from Allied Chemical and Petrolite Corporation, Epolene N-15, commercially available from Eastman Chemical Products, Inc., Viscol 550-P, a low weight average molecular weight polypropylene available from Sanyo Kasei K.K., and similar materials. The commercially available polyethylenes selected have a molecular weight of from about 1,000 to about 1,500, while the commercially available polypropylenes utilized for the toner compositions of the present invention are believed to have a molecular weight of from about 4,000 to about 5,000. Many of the polyethylene and polypropylene compositions useful in the present invention are illustrated in British Patent 1,442,835, the disclosure of which is totally incorporated herein by reference.

The low molecular weight wax materials are present in the toner composition of the present invention in various effective amounts, however, generally these waxes are present in the toner composition in an amount of from about 1 percent by weight to about 15 percent by weight, and preferably in an amount of from about 2 percent by weight to about 10 percent by weight.

Also encompassed within the scope of the present invention are colored toner and developer compositions comprised of toner resin particles, carrier particles, the charge enhancing additive mixture illustrated herein, and as pigments or colorants red, blue, green, brown, magenta, cyan and/or yellow particles, as well as mixtures thereof. More specifically, with regard to the generation of color images utilizing a developer composition with the charge enhancing additives of the present invention, illustrative examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra-4-(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy aceto-acetanilide, and Permanent Yellow FGL. The aforementioned pigments are incorporated into the toner composition in various suitable effective amounts providing the objectives of the present invention are achieved. In one embodiment, these colored pigment particles are present in the toner composition in an amount of from about 2 percent by weight to about 15 percent by weight calculated on the weight of the toner resin particles.

For the formulation of developer compositions, there are mixed with the toner particles carrier components, particularly those that are capable of triboelectrically assuming an opposite polarity to that of the toner composition. Accordingly, the carrier particles of the present invention are selected to be of a negative polarity enabling the toner particles which are positively charged to adhere to and surround the carrier particles. Illustrative examples of carrier particles include iron powder, steel, nickel, iron ferrites, copper zinc ferrites, other ferrites, silicon dioxide, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and an organo silane, such as triethoxy silane, reference U.S. Pat. Nos. 3,526,533 and 3,467,634, the disclosures of which are totally incorporated herein by reference; polymethyl methacrylates; other known coatings; and the like. The carrier particles may also include in the coating, which coating can be present in one embodiment in an amount of from about 0.1 to about 3 weight percent conductive substances such as carbon black in an amount of from about 5 to about 30 percent by weight. Polymer coatings not in close proximity in the triboelectric series can also be selected, reference copending applications U.S. Ser. No. 136,791, and U.S. Ser. No. 136,792, the disclosures of which are totally incorporated herein by reference, including for example Kynar and polymethylmethacrylate mixtures (40/60). Generally, coating weights can vary; generally, however, from about 0.5 to about 2, and preferably from about 1 to about 3 weight percent coating weight is selected.

Furthermore, the diameter of the carrier particles is generally from about 50 microns to about 1,000 microns thereby permitting them to possess sufficient density and inertia to avoid adherence to the electrostatic images during the development process. The carrier component can be mixed with the toner composition in various suitable combinations, however, best results are obtained when about 1 to 5 parts per toner to about 10 parts to about 200 parts by weight of carrier are selected.

The toner composition of the present invention can be prepared by a number of known methods as indicated herein including extrusion, or melt blending the toner resin particles, pigment particles or colorants, and the charge enhancing additive mixture of the present invention, followed by mechanical attrition. Other methods include those well known in the art such as spray drying, melt dispersion, extrusion processing, dispersion polymerization, and suspension polymerization. Also, as indicated herein the toner composition without the charge enhancing additive can be prepared, followed by the addition of colloidal silicas surface treated with the charge additive mixture.

The toner and developer compositions of the present invention may be selected for use in electrostatographic imaging apparatuses containing therein conventional photoreceptors providing that they are capable of being charged negatively. Thus, the toner and developer compositions of the present invention can be used with layered photoreceptors that are capable of being charged negatively, such as those described in U.S. Pat. No. 4,265,990, the disclosure of which is totally incorporated herein by reference. Illustrative examples of inorganic photoreceptors that may be selected for imaging and printing processes include selenium, selenium alloys, such as selenium arsenic (preferably 99.5/0.5), selenium tellurium (preferably 75/25), and the like; and halogen doped selenium substances, and halogen doped selenium alloys, preferably with from about 5 to about 300 parts per million. Other similar photoreceptors can be selected providing many of the objectives of the present invention are achievable. Specifically, the imaging members illustrated in U.S. Pat. No. 4,752,550, reference column 11, can be selected and the imaging device may also include a Viton fuser roll. It is believed subsequent to visual observation after 100,000 imaging cycles that no damage will occur to the Viton fuser roll, that is the Viton will not turn black, will not crack, and the surface will not harden; but rather remain smooth and soft although slightly darkened.

The formed toner compositions are usually jetted and classified subsequent to preparation to enable toner particles with a preferred average diameter of from about 5 to about 25 microns, and preferably from about 6 to about 15 microns. Also, the toner compositions of the present invention preferably posses a triboelectric charge of from about 0.1 to about 2 femtocoulombs per micron as determined by the known charge spectograph. Admix time for the toners of the present invention are preferably from about 5 seconds to 1 minute, and more specifically from about 5 to about 15 seconds as determined by the known charge spectograph. These toner compositions with rapid admix characteristics enable, for example, the development of images in electrophotographic imaging apparatuses, which images have substantially no background deposits thereon, even at high toner dispensing rates in some instances, for instance exceeding 15 grams per minute; and further, such toner compositions can be selected for high speed electrophotographic apparatuses, that is those exceeding 70 copies per minute. Moreover, the toner compositions of the present invention are substantially insensitive to relative humidity, for example relative humidities of from about 20 to about 80 percent, and preferably from about 50 to about 80 percent.

The tetraalkyl ammonium bisulfates of the present invention and processes for the preparation thereof are illustrated in copending applications U.S. Ser. No. 396509 filed 8-21-89, entitled "Toner and Developer Compositions With Charge Enhancing Additives", and U.S. Ser. No. 396497 filed 8-21-89, entitled "Quaternary Ammonium Compounds and Processes Thereof", the disclosures of each of these applications being totally incorporated herein by reference.

In one embodiment illustrated in the aforementioned copending applications tetraalkyl ammonium salts, such as the bisulfates of the present invention are prepared by the reaction of water insoluble quaternary ammonium salts, such as distearyl dimethyl ammonium methyl sulfate; distearyl dialkyl ammonium halides, such as distearyl dimethyl ammonium halide, especially the chloride or bromide; dialkyl distearyl ammonium hydroxides, wherein alkyl contains form 10 to about 30 carbon atoms, such as dimethyl distearyl ammonium hydroxide, and diethyl distearyl ammonium hydroxide; distearyl ammonium tosylate, such as dimethyl distearyl ammonium tosylate; distearyl dialkyl, wherein alkyl, for example, contains from 1 to about 30 carbon atoms; ammonium alkyl, wherein alkyl, for example, contains from 1 to about 20 carbon atoms; sulfonate; and the like with a sulfuric acid in the presence of heat. Usually a solvent for the acid, such as water, is selected. The acid is selected in effective amounts of, for example, from about 1 to about 10 molar equivalents, and preferably from about 5 to about 8 molar equivalents to about 1 molar equivalent of the quaternary ammonium salt reactant. Heating of the reaction mixture can be accomplished at various temperatures depending, for example, on the reactants selected, preferably the reaction, however, is accomplished at a temperature of from about 40° to about 100° C. Distearyl dimethyl ammonium methyl sulfate can be heated in an appropriate solvent or solvent mixture in the presence of stoichiometric amount or sulfuric acid. The solvent system comprised, for example, of water, water and alcohol mixtures, water and tetrahydrofuran mixtures, water and acetone mixtures, and water and halogenated, especially chlorinated, solvent mixtures may be selected permitting a single phase or two phase system to facilitate the speed thereof by, for example, from days to hours of the reaction and enabling the isolation and purification of the desired quaternary ammonium product. In the one phase method, for example, there is dissolved the DDAMS quaternary ammonium salt reactant, and the concentrated sulfuric acid, water, a water miscible organic cosolvent including acetone, dioxane, glycol ethers, tetrahydrofuran, or an aqueous alcohol, preferably methanol, or tetrahydrofuran. Thereafter, the resulting solution can be heated, followed by cooling whereby a precipitate of the desired bisulfate product is obtained subsequent to isolation by filtration. The product may be purified by, for example, known recrystallization methods. With a two-phase process, the appropriate quaternary ammonium salt in a solvent such as methylene chloride or chloroform is mixed and heated with an aqueous sulfuric acid solution. One preferred two-phase method comprises, as illustrated herein, heating the appropriate powdered DDAMS quaternary ammonium salt reactant in suspension with excess aqueous sulfuric acid. In the aforementioned two-phase methods, the desired bisulfate product can be isolated directly by filtration, and thereafter purified by recrystallization, or other similar methods when desirable. The resulting products obtained with the process of the present invention can be identified by a number of techniques including melting point information, differential scanning calorimetry, infrared spectra, carbon and proton nuclear magnetic resonance, ion chromotography, elemental analysis, and the like.

A typical process of preparation involves heating at an effective temperature of, for example, from about 40° to about 100° C. for an appropriate period of time, such as from about 5 to about 15 hours, distearyl dimethyl ammonium chloride (DDACl), or the corresponding methyl sulfate salt, distearyl dimethyl ammonium methyl sulfate (DDAMS) in an aqueous solution, about one molar equivalent in 85 molar equivalents of water, and 10 molar equivalents of sulfuric acid in 56 molar equivalents of water. The crude product resulting after cooling to room temperature can be collected by filtration, and then purified by washing with various solvents such as acetone, followed by recrystallization from, for example, an appropriate solvent such as acetone or methanol, and the like.

Preferred process embodiments of the present invention comprise the addition of the appropriate quaternary ammonium salt such as distearyl dimethyl ammonium methyl sulfate (DDAMS) and water, followed by dissolving sulfuric acid in the aforementioned mixture, and thereafter separating the desired bisulfate product therefrom wherein water is selected in a sufficient amount to suspend the quaternary ammonium salt reactant, that is for example for one-half part of water to one part of reactant; the addition of a cosolvent to the water, acid, DDAMS reactants, which cosolvent includes tetrahydrafuran, aliphatic alcohols such as methanol, ethanol, propanol, butanol; dioxane, glycol ethers, acetone, and the like, and then separating the desired product from the reaction mixture whereby there is enabled the DDAMS reactant to be substantially more soluble, for example, and thereby enabling a scale up in manufacturing processes in an effective manner wherein the mixture, for example, comprises from 1 part of water to 0.1 part of a second solvent such as acetone, dioxane, glycol ethers, preferably 0.1:1.0 to about 20:10 of second cosolvent to water, tetrahydrofuran, alcohols, and the like; a two-phase system wherein there is formed a first water layer and a second solvent, such as chloroform or toluene layer, thus the DDAMS reactant is dissolved in chloroform and the water layer containing the acid. Reaction is accomplished at the water interface and the product resulting is present in the organic phase containing the chloroform and the toluene. Generally, in the aforementioned two-phase reaction from about 1 part of water to 0.1 to 20 parts by weight of the second solvent such as chloroform or alcohol is selected. The two-phase system process generally comprises the preparation of quaternary ammonium compounds $R_4N^+X^-$ wherein a quaternary ammonium salt is dissolved in a water immiscible organic solvent and added to a mixture comprised of an acid and water, thereafter heating whereby a reaction occurs at the interface between the organic solvent layer and the water layer, cooling, separating the organic layer from the water layer, and obtaining the product from the organic layer.

Other embodiments for the preparation of the bisulfate salts of the present invention, which embodiments are illustrated in the aforementioned copending applications, include a process for the preparation of quaternary ammonium compounds of the formula $R'_2R''_2N^+X^-$ wherein R', and R'' are independently selected from the group consisting of alkyl, aryl, and alkylaryl; and $X^-$ is an anion, which comprises the reaction by heating a water insoluble quaternary ammonium salt with an acid; a process for the preparation of quaternary ammonium compounds wherein a quaternary ammonium salt is dissolved in a water immiscible organic solvent and added to a mixture comprised of an acid and water, thereafter heating whereby a reaction occurs at the interface between the organic solvent layer and the water layer, cooling, separating the organic layer from the water layer, and obtaining the product from the organic layer; and wherein the quaternary salt reactant is preferably distearyl dimethyl ammonium methyl sulfate (DDAMS), and the acid is sulfuric acid.

The following examples are being supplied to further define various species of the present invention, it being noted that these examples are intended to illustrate and not limit the scope of the present invention. Parts and percentages are by weight unless otherwise indicated.

EXAMPLE I

There was prepared in an extrusion device, available as ZSK53 from Werner Pfleiderer, a toner composition by adding thereto 77.45 percent by weight of suspension polymerized styrene butadiene copolymer (87/13) particles, reference U.S. Pat. No. 4,558,108, the disclosure of which is totally incorporated herein by reference; 17.0 percent by weight of the magnetite Mapico Black; 5.0 percent by weight of Regal 330® carbon black; 0.45 percent by weight of the charge enhancing additive distearyl dimethyl ammonium methyl sulfate, and 0.10 percent by weight of the charge enhancing additive distearyl dimethyl ammonium bisulfate obtained from Example IX. Subsequently, the toner was subjected to grinding in a Sturtevant micronizer enabling particles with a volume median diameter of from 8 to 12 microns as measured by a Coulter Counter. Thereafter, the aforementioned toner particles were classified in a Donaldson Model B classifier for the purpose of removing fine particles, that is those with a volume median diameter of less than about 4 microns.

Subsequently, the above formulated toner, 3 parts by weight, was mixed with 97 parts by weight of a carrier containing a steel core with a polymer mixture coating, 0.70 percent by weight, which polymer mixture contained 40 parts by weight of polyvinylidene fluoride, and 60 parts by weight of polymethyl methacrylate, and wherein mixing was accomplished in a paint shaker for 10 minutes. There resulted on the toner composition, as determined in the known Faraday Cage apparatus, a positive triboelectric charge of 20 microcoulombs per gram.

There was then added to the above prepared developer composition 1 part by weight of a second toner comprised of 77.45 percent by weight of suspension polymerized styrene butadiene copolymer (87/13) resin particles, reference U.S. Pat. No. 4,558,108, the disclosure of which is totally incorporated hereby by reference; 17.0 percent by weight of the magnetite Mapico Black; 5.0 percent by weight of Regal 330® carbon black; 0.45 percent by weight of the charge enhancing additive distearyl dimethyl ammonium methyl sulfate, and 0.10 percent by weight of the charge enhancing additive distearyl dimethyl ammonium bisulfate. Thereafter, the charge distribution of the resulting developer was measured as a function of the mixing time, and it was determined by a charge spectrograph that the admixing time was about 15 seconds, the shortest time measured on the spectrograph in this embodiment, for the 1 part by weight of the second added toner.

EXAMPLE II

There was prepared in an extrusion device, available as ZSK53 from Werner Pfleiderer, a toner composition by adding thereto 77.7 percent by weight of suspension polymerized styrene butadiene copolymer resin particles (87/13), reference U.S. Pat. No. 4,558,108, the disclosure of which is totally incorporated herein by reference; 17.0 percent by weight of the magnetite Mapico Black; 5.0 percent by weight of Regal 330® carbon black; and a charge additive mixture comprised of 0.25 percent by weight of the charge enhancing additive distearyl dimethyl ammonium methyl sulfate, and 0.05 percent by weight of the charge enhancing additive distearyl dimethyl ammonium bisulfate obtained from Example IX. Subsequently, the resulting toner was subjected to grinding in a Sturtevant micronizer enabling particles with a volume median diameter of from 8 to 12 microns as measured by a Coulter Counter. Thereafter, the aforementioned toner particles were classified in a Donaldson Model B classifier for the purpose of removing fine particles, that is those with a volume median diameter of less than about 4 microns.

Thereafter, the above formulated toner, 3 parts by weight, was mixed with 97 parts by weight of a carrier containing a steel core with a polymer mixture coating, 0.70 percent by weight, which polymer mixture contained 40 parts by weight of polyvinylidene fluoride, and 60 parts by weight of polymethyl methacrylate, and wherein mixing was accomplished in a paint shaker for 10 minutes. There resulted on the toner composition, as determined in the known Faraday Cage apparatus, a positive triboelectric charge of 15 microcoulombs per gram.

There was then added to the above prepared developer composition 1 part by weight of a second toner comprised of 77.7 percent by weight of suspension polymerized styrene butadiene copolymer resin particles (87/13), reference U.S. Pat. No. 4,558,108, the disclosure of which is totally incorporated herein by reference; 17.0 percent by weight of the magnetite Mapico Black; 5.0 percent by weight of Regal 330® carbon black; 0.25 percent by weight of the charge enhancing additive distearyl dimethyl ammonium methyl sulfate; and 0.05 percent by weight of the above charge enhancing additive distearyl dimethyl ammonium bisulfate of Example IX. Thereafter, the charge distribution of the resulting developer was measured as a function of the mixing time, and it was determined by a charge spectrograph that the admixing time was less than 15 seconds (about 5 to 10 estimated seconds), the shortest time measured on the spectrograph in this embodiment, for the 1 part of second added toner.

EXAMPLE III

There was prepared in an extrusion device, available as ZSK53 from Werner Pfleiderer, a toner composition by adding thereto 80.0 percent by weight of suspension polymerized styrene butadiene copolymer resin particles (87/13), reference U.S. Pat. No. 4,558,108, the disclosure of which is totally incorporated herein by reference; 17.0 percent by weight of the magnetite Mapico Black; 2.5 percent by weight of Regal 330® carbon black; 0.45 percent by weight of the charge enhancing additive distearyl dimethyl ammonium methyl sulfate; and 0.05 percent by weight of the charge enhancing additive distearyl dimethyl ammonium bisulfate obtained from Example IX. Subsequently, the formed toner was subjected to grinding in a Sturtevant micronizer enabling particles with a volume median diameter of from 8 to 12 microns as measured by a Coulter Counter. Thereafter, the aforementioned toner particles were classified in a Donaldson Model B classifier for the purpose of removing fine particles, that is those with a volume median diameter of less than about 4 microns.

Subsequently, the above formulated toner, 3 parts by weight, was mixed with 97 parts by weight of a carrier containing a steel core with a polymer mixture coating thereover, 0.70 percent by weight, which polymer mixture contained 40 parts by weight of polyvinylidene fluoride, and 60 parts by weight of polymethyl methacrylate, and wherein mixing was accomplished in a paint shaker for 10 minutes. There resulted on the toner composition, as determined in the known Faraday Cage apparatus, a stable positive triboelectric charge of 26 microcoulombs per gram.

There was then added to the above prepared developer composition 1 part by weight of a second toner comprised of 80.0 percent by weight of suspension polymerized styrene butadiene copolymer resin particles (87/13), reference U.S. Pat. No. 4,558,108, the disclosure of which is totally incorporated herein by reference; 17.0 percent by weight of the magnetite Mapico Black; 2.5 percent by weight of Regal 330® carbon black; 0.45 percent by weight of the charge enhancing additive distearyl dimethyl ammonium methyl sulfate; and 0.05 percent by weight of the above charge enhancing additive distearyl dimethyl ammonium bisulfate. Thereafter, the charge distribution of the resulting developer was measured as a function of the mixing time, and it was determined by a charge spectrograph that the admixing time was about 30 seconds for the 1 part of second added toner.

EXAMPLE IV

There was prepared in an extrusion device, available as ZSK53 from Werner Pfleiderer, a toner composition by adding thereto 80.15 percent by weight of suspension polymerized styrene butadiene copolymer resin particles (87/13), reference U.S. Pat. No. 4,558,108, the disclosure of which is totally incorporated herein by reference; 17.0 percent by weight of the magnetite Mapico Black; 2.5 percent by weight of Regal 330® carbon black; 0.25 percent by weight of the charge enhancing additive distearyl dimethyl ammonium methyl sulfate; and 0.10 percent by weight of the charge enhancing additive distearyl dimethyl ammonium bisulfate obtained from Example IX. Subsequently, the resulting toner was subjected to grinding in a Sturtevant micronizer enabling particles with a volume median diameter of from 8 to 12 microns as measured by a Coulter Counter. Thereafter, the aforementioned toner particles were classified in a Donaldson Model B classifier for the purpose of removing fine particles, that is those with a volume median diameter of less than about 4 microns.

Subsequently, the above formulated toner, 3 parts by weight, was mixed with 97 parts by weight of a carrier containing a steel core with a polymer mixture coating, 0.70 percent by weight, which polymer mixture contained 40 parts by weight of polyvinylidene fluoride, and 60 parts by weight of polymethyl methacrylate, which mixing was accomplished in a paint shaker for 10 minutes. There resulted on the toner composition, as determined in the known Faraday Cage apparatus, a positive triboelectric charge of 21 microcoulombs per gram.

There was then added to the above prepared developer composition 1 part by weight of a second toner comprised of 80.15 percent by weight of suspension polymerized styrene butadiene copolymer resin particles, reference U.S. Pat. No. 4,558,108, the disclosure of which is totally incorporated herein by reference; 17.0 percent by weight of the magnetite Mapico Black; 2.5 percent by weight of Regal 330® carbon black; 0.25 percent by weight of the charge enhancing additive distearyl dimethyl ammonium methyl sulfate; and 0.10 percent by weight of the above charge enhancing additive distearyl dimethyl ammonium bisulfate. Thereafter, the charge distribution of the resulting developer was measured as a function of the mixing time, and it was determined by a charge spectrograph that the admixing time was less than 15 seconds, the shortest time measured on the spectrograph in this embodiment, for the 1 part of second added toner.

EXAMPLE V

There was prepared in an extrusion device, available as ZSK53 from Werner Pfleiderer, a toner composition by adding thereto 74.52 percent by weight of suspension polymerized styrene butadiene copolymer resin particles (87/13), reference U.S. Pat. No. 4,558,108, the disclosure of which is totally incorporated herein by reference; 17.0 percent by weight of the magnetite Mapico Black; 3.15 percent by weight of Regal 330® carbon black; 0.22 percent by weight of the charge enhancing additive distearyl dimethyl ammonium methyl sulfate; and 0.11 percent by weight of the charge enhancing additive distearyl dimethyl ammonium bisulfate obtained from Example VIII. Subsequently, the resulting toner was subjected to grinding in a Sturtevant micronizer enabling particles with a volume median diameter of from 8 to 12 microns as measured by a Coulter Counter. Thereafter, the aforementioned toner particles were classified in a Donaldson Model B classifier for the purpose of removing fine particles, that is those with a volume median diameter of less than 4 microns.

Subsequently, the above formulated toner, 3 parts by weight, was mixed with 97 parts by weight of a carrier containing a steel core with a polymer mixture coating, 0.70 percent by weight, which polymer mixture containing 40 parts by weight of polyvinylidene fluoride, and 60 parts by weight of polymethyl methacrylate, and wherein mixing was accomplished in a paint shaker for 10 minutes. There resulted on the toner composition, as determined in the known Faraday Cage apparatus, a stable positive triboelectric charge of 20 microcoulombs per gram.

There was then added to the above prepared developer composition 1 part by weight of a second toner comprised of 74.52 percent by weight of suspension polymerized styrene butadiene copolymer resin particles, reference U.S. Pat. No. 4,558,108, the disclosure of which is totally incorporated herein by reference; 17.0 percent by weight of the magnetite Mapico Black; 3.15 percent by weight of Regal 330® carbon black; 0.22 percent by weight of the charge enhancing additive distearyl dimethyl ammonium methyl sulfate; and 0.11 percent by weight of the above charge enhancing additive distearyl dimethyl ammonium bisulfate. Thereafter, the charge distribution of the resulting developer was measured as a function of the mixing time, and it was determined by a charge spectrograph that the admixing time was less than 15 seconds, the shortest time measured on the spectrograph in this embodiment, for the 1 part of second adder toner.

EXAMPLE VI

There was prepared in an extrusion device, available as ZSK53 from Werner Pfleiderer, a toner composition by adding thereto 74.53 percent by weight of suspension polymerized styrene butadiene copolymer resin particles (87/13), reference U.S. Pat. No. 4,558,108, the disclosure of which is totally incorporated herein by reference; 17.0 percent by weight of the magnetite Mapico Black; 3.15 percent by weight of Regal 330® carbon black; 0.26 percent by weight of the charge enhancing additive distearyl dimethyl ammonium methyl sulfate; and 0.06 percent by weight of the above charge enhancing additive distearyl dimethyl ammonium bisulfate obtained from Example IX. Subsequently, the resulting toner was subjected to grinding in a Sturtevant micronizer enabling particles with a volume median diameter of from 8 to 12 microns as measured by a Coulter Counter. Thereafter, the aforementioned toner particles were classified in a Donaldson Model B classifier for the purpose of removing fine particles, that is those with a volume median diameter of less than 4 microns.

Subsequently, the above formulated toner, 3 parts by weight, was mixed with 97 parts by weight of a carrier containing a steel core with a polymer mixture coating, 0.70 percent by weight, which polymer mixture contained 40 parts by weight of polyvinylidene fluoride, and 60 parts by weight of polymethyl methacrylate, and wherein mixing was accomplished in a paint shaker for 10 minutes. There resulted on the toner composition, as determined in the known Faraday Cage apparatus, a positive triboelectric charge of 20 microcoulombs per gram.

There was then added to the above prepared developer composition 1 part by weight of a second toner comprised of 74.53 percent by weight of suspension polymerized styrene butadiene copolymer resin particles (87/13), reference U.S. Pat. No. 4,558,108, the disclosure of which is totally incorporated herein by reference; 17.0 percent by weight of the magnetite Mapico Black; 3.15 percent by weight of Regal 330® carbon black; 0.26 percent by weight of the charge enhancing additive distearyl dimethyl ammonium methyl sulfate; and 0.06 percent by weight of the above charge enhancing additive distearyl dimethyl ammonium bisulfate. Thereafter, the charge distribution of the resulting developer was measured as a function of the mixing time, and it was determined by a charge spectrograph that the admixing time was about 15 seconds, the shortest time measured on the spectrograph in this embodiment, for the 1 part of second added toner.

The aforementioned prepared toners are also believed to be substantially insensitive to relative humidities of from about 20 to abouto 80 percent, and moreover these toners are compatible with Viton fuser rolls, that is they do not substantially adversely affect these rolls, reference U.S. Pat. No. 4,752,550, the disclosure of which has been totally incorporated herein by reference. Moreover, it is believed that with the toners and developers of the present invention images of excellent resolution and with no background deposits can be obtained in an imaging test fixture with a layered imaging member such as that illustrated in U.S. Pat. No. 4,265,990, the disclosure of which has been totally incorporated herein by reference, which member is negatively charged.

EXAMPLE VII

There was prepared in an extrusion device, available as ZSK53 from Werner Pfleiderer, a toner composition by adding to the device 79.985 percent by weight of suspension polymerized styrene butadiene copolymer resin particles (87/13), reference U.S. Pat. No. 4,558,108, the disclosure of which is totally incorporated herein by reference; 17.0 percent by weight of the magnetite Mapico Black; 3.0 percent by weight of Regal 330® carbon black; 0.075 percent by weight of the charge enhancing additive distearyl dimethyl ammonium methyl sulfate; and 0.075 percent by weight of the charge enhancing additive distearyl dimethyl ammonium bisulfate of Example IX. Subsequently, the toner, was subjected to grinding in an Alpine Fluid Bed Jet Model 200, available from Hosokawa Micron International, enabling toner particles with a volume median diameter of from 8 to 12 microns as measured by a Coulter Counter. Thereafter, the aforementioned toner particles were classified in a Donaldson Model B classifier for the purpose of removing fine particles, that is those with a volume median diameter of less than 4 microns.

Subsequently, the above formulated toner, 3 parts by weight, was mixed with 97 parts by weight of a carrier containing a steel core with a polymer mixture thereof, 0.70 percent by weight, which polymer mixture was comprised of 50 parts by weight of polyvinylidene fluoride, and 50 parts by weight of polymethyl methacrylate, and wherein mixing was accomplished in a paint shaker for 10 minutes. There resulted on the toner composition, as determined in the known Faraday Cage apparatus, a positive triboelectric charge of 13 microcoulombs per gram.

There was then added to the above prepared developer composition 1 part by weight of an uncharged toner comprised of 79.985 percent by weight of suspension polymerized styrene butadiene copolymer resin particles (87/13) reference U.S. Pat. No. 4,558,108, the disclosure of which is totally incorporated herein by reference; 17.0 percent by weight of the magnetite Mapico Black; 3.0 percent by weight of Regal 330° carbon black; 0.075 percent by weight of the above charge enhancing additive distearyl dimethyl ammonium methyl sulfate; and 0.075 percent by weight of the above charge enhancing additive distearyl dimethyl ammonium bisulfate of Example IX. Thereafter, the charge distribution of the resulting developer was measured as a function of the mixing time, and it was determined by a charge spectrograph that the admixing time was less than 15 seconds, the shortest time measured on the spectrograph in this embodiment, for the added uncharged toner.

This developer was then placed in a high speed electrostatic imaging machine available from Xerox Corporation as the 5090 TM and subsequent to engagement development there were generated developed copies of high resolution with excellent solid area, and substantially no background deposits.

EXAMPLE VIII

Chemical Synthesis of Distearyl Dimethyl Ammonium Bisulfate (DDABS) by Ionic Exchange Reaction of distearyl dimethyl ammonium methyl sulfate (DDAMS): to a suspension of 300 grams (0.45 mol) of DDAMS in 1,500 milliliters of water (3 liter Buchner filter flask) was cautiously added a solution of 250 milliliters of concentrated sulfuric acid ($H_2SO_4$, 4.5 mol, 10 equivalents) in 1,000 milliliters of ice water. The resulting stirred mixture was heated to about 70° C. for four hours then cooled to room temperature overnight (18 hours) followed by filtration under reduced pressure for 24 hours with Whatman #4 paper. The resultant tan semigelatinous product filter cake was then suspended in 1,500 milliliters of water and heated to from about 50° to about 60° C. for about 30 minutes, cooled to room temperature, then filtered under reduced pressure. The product filter cake (216 grams) was recrystallized (reconstituted) from an acetone, 1,500 milliliters/water, 100 milliliters, mixture and a second time from methanol 1,000 milliliters/water, 100 milliliters, to separate on cooling, filtering, and vacuum drying 187.8 grams of an off-white powder product DDABS, mp 96° to 100° C. A second, 22.5 grams, and third, 6.2 grams, fraction of less pure material was isolated from the mother liquor and these fractions can be further purified by recrystallization to improve the overall yield. Total isolated yield of the above product DDABS (all fractions) of the formula $C_{38}H_{81}NSO_4$ was 74 percent. $^1H$ NMR ($CDCl_3$) for the first 187.8 gram fraction was δ6.43 (broad m, 1H, $HSO_4$), 3.21 to 3.29 (multiplet containing a singlet, 10H, $(CH_3)_2N$ and $(CH_2)_2N$, 1.66 (broad m, 4H, beta $CH_2$), 1.20 to 1.32 (m 30H, aliphatic $CH_2$), and 0.86 to 0.89 (t, 6H, aliphatic $CH_3$); IR(KBr) 1,011, 1,185, 1,471, 1,490 (shoulder), 2,918.

Analysis Calculated for 187.8 gram fraction of DDABS $C_{38}H_{81}NSO_4$: C, 70.40; H, 12.62; N, 2.16; S, 4.95. Found: C, 70.62; H, 12.90; N, 2.16; S, 5.02.

EXAMPLE IX

The product of Example VIII, DDABS, was also prepared as follows. To 1,200 milliliters of ice water was cautiously added 250 milliliters of concentrated sulfuric acid ($H_2SO_4$), then the resulting mixture was stirred and allowed to thermally equilibrate at ambient temperature for about 2 hours. The aforementioned prepared aqueous $H_2SO_4$ solution was added to a suspension of 500 grams of DDAMS (0.76 mol) in 1,000 milliliters water. The resulting suspension was mechanically stirred and heated on a hot plate (70° to 80° C.) in a 3 liter Buchner filter flask for 4 hours. The suspension was cooled to room temperature then filtered under reduced pressure overnight (18 hours) to remove the aqueous $H_2SO_4$. The water filtrate, aqueous $H_2SO_4$, was carefully neutralized with NaOH to a pH of about 7 before disposal. The retentate, an off-white tan colored solid paste, was suspended in 2 liters of acetone with vigorous mixing then filtered under reduced pressure to remove additional water, $H_2SO_4$ and acetone soluble impurities. This filter cake was then suspended in 2 liters of hot acetone with vigorous mechanical stirring for about 30 minutes. The acetone suspension was cooled in an ice bath then filtered under reduced pressure to separate after drying about 450 grams of an off-white solid. The infrared spectrum of this material indicated a slight contamination was present. The material was again suspended in 2 liters of hot acetone with mechanical stirring for 30 minutes then cooled and filtered to separate 407 grams (0.628 mol, 83 percent yield) of an off-white solid powder, mp 90° C. (softening), 110° C. (liquid) of the above product DDABS of analytically pure material, about 99.5 percent pure.

This procedure has the particular advantage that it avoids having to hot filter/recrystallize the crude product as in Example VIII. Instead, this is accomplished by the acetone washing and reprecipitation steps.

EXAMPLE X

A solution of 25 grams (0.0378) of DDAMS in 200 milliliters of $CHCl_3$ was mixed with a solution of 15 milliliters of concentrated $H_2SO_4$ in 15 milliliters of water and the mixture was heated with stirring for 3 hours. The reaction mixture was cooled to zero (0)°C. in an ice bath to separate a white precipitate which was collected by filtration. The crude material was recrystallized from acetone to afford 21 grams of the DDABS product, identified in accordance with the procedure of Example VIII, as a white powder, mp 91° to 106° C. (yield 86 percent of theory).

Also, the compounds prepared by the processes of Examples IX and X were further identified by $^1H$ NMR analysis and infrared (IR) analysis.

In Examples I to VI the prepared second added toner was uncharged, reference Example VII. Further, processes for preparing quaternary ammonium salts including some of the bisulfates of the present invention by an ion exchange, or ion pair extraction method is known, reference for example *Phase Transfer Catalysis, Principles and Techniques,* Academic Press, New York, 1978, especially page 76, C. M. Starks, and C. Liotta, the disclosure of this textbook being totally incorporated herein by reference, and "Preparative Ion Pair Extraction", *Apotekarsocieteten/Hassle, Lakemidel,* pages 139 to 148, Sweden, 1974, the disclosure of which is totally incorporated herein by reference, which illustrates the preparation of certain bisulfates with water soluble ammonium salt reactants and a two-phase method wherein the product resides in the water phase.

Other modifications of the present invention will occur to those skilled in the art subsequent to a review of the present application. These modifications, as well as equivalents thereof, are intended to be included within the scope of the present invention.

What is claimed is:

1. A toner composition comprised of resin, pigment, and a mixture of charge enhancing additives comprised of a first additive of quaternary ammonium salts and a second additive of an alkyl ammonium bisulfate.

2. A toner composition comprised of resin, pigment, and a mixture of charge enhancing additives comprised of a first additive of distearyl dimethyl ammonium methyl sulfate, and a second additive comprised of a tetraalkyl ammonium bisulfate.

3. A positively charged toner composition comprised of resin particles, pigment particles, and a mixture of charge enhancing additives comprised of a first additive of distearyl dimethyl ammonium methyl sulfate, and a second additive selected from the group consisting of distearyl dimethyl ammonium bisulfate, tetramethyl ammonium bisulfate, tetraethyl ammonium bisulfate, and tetrabutyl ammonium bisulfate.

4. A toner composition in accordance with claim 2 wherein the first additive is present in an amount of from about 0.05 to about 1 weight percent, and the second additive is present in an amount of from about 0.05 to about 1 weight percent.

5. A toner composition in accordance with claim 2 wherein the first additive is present in an amount of about 0.2 and the second additive is present in an amount of about 0.1 weight percent.

6. A toner composition in accordance with claim 2 wherein the additive mixture is incorporated into the toner.

7. A toner composition in accordance with claim 2 wherein the additive mixture is present on the surface of the toner composition.

8. A toner composition in accordance with claim 2 wherein the first additive is functioning primarily as a charge additive, and the second additive is functioning as an admix control component.

9. A toner composition in accordance with claim 2 with an admix time of from about 10 to about 60 seconds.

10. A toner composition in accordance with claim 2 with an admix time of from less than about 15 seconds.

11. A toner composition in accordance with claim 2 with a triboelectric charge of from about 10 to about 40 microcoulombs per gram.

12. A toner composition in accordance with claim 2 wherein a colloidal silica is treated with the charge enhancing additive mixture.

13. A toner composition in accordance with claim 2 wherein the resin particles are comprised of styrene polymers, polyesters, or mixtures thereof.

14. A toner composition in accordance with claim 2 wherein the resin particles are comprised of styrene acrylates, styrene methacrylates, or styrene butadienes.

15. A toner composition in accordance with claim 2 containing a wax component with a weight average molecular weight of from about 1,000 to about 6,000.

16. A toner composition in accordance with claim 15 wherein the waxy component is selected from the group consisting of polyethylene and polypropylene.

17. A toner composition in accordance with claim 2 containing as external additives metal salts of a fatty acid, colloidal silicas, or mixtures thereof.

18. A toner composition in accordance with claim 2 wherein the pigment particles are carbon black, magnetites, or mixtures thereof; cyan, magenta, yellow, red, blue, green, brown, and mixtures thereof.

19. A developer composition comprised of the toner composition of claim 1 and carrier particles.

20. A developer composition comprised of the toner composition of claim 2 and carrier particles.

21. A developer composition comprised of the toner composition of claim 3 and carrier particles.

22. A developer composition in accordance with claim 21 wherein the carrier particles are comprised of ferrites, steel, or an iron powder.

23. A developer composition in accordance with claim 21 wherein the carrier particles are comprised of a core with a polymer coating thereover.

24. A developer composition in accordance with claim 23 wherein the coating is comprised of a methyl terpolymer, a polyvinylidine fluoride, a polymethyl methacrylate, or a mixture of polymers not in close proximity in the triboelectric series.

25. A method of imaging which comprises formulating an electrostatic latent image on a photoreceptor, affecting development thereof with the toner composition of claim 1, and thereafter transferring the developed image to a suitable substrate.

26. A method of imaging in accordance with claim 25 wherein the transferred image is permanently fixed to the substrate.

27. A method of imaging which comprises formulating an electrostatic latent image on a negatively charged photoreceptor, affecting development thereof with the toner composition of claim 3, and thereafter transferring the developed image to a suitable substrate.

28. A method of imaging in accordance with claim 27 wherein the transferred image is permanently fixed to the substrate.

29. A single component positively charged toner composition comprised of resin particles, magnetite components, and the charge enhancing additive mixture of claim 1.

30. A single component positively charged toner composition comprised of resin particles, magnetite components, and the charge enhancing additive mixture of claim 2.

31. A single component positively charged toner composition comprised of resin particles, magnetite components, and the charge enhancing additive mixture of claim 3.

32. A toner composition in accordance with claim 3 wherein the first charge enhancing additive is present in an amount of 0.22 weight percent, and the second charge enhancing additive is present in an amount of 0.05 weight percent.

33. A toner composition in accordance with claim 32 wherein the first additive is distearyl dimethyl ammonium methyl sulfate, and the second additive is distearyl dimethyl ammonium bisulfate.

34. A toner composition in accordance with claim 3 wherein the first additive is present in an amount of from about 0.05 to about 1 weight percent, and the second additive is present in an amount of from about 0.05 to about 1 weight percent.

35. A toner composition in accordance with claim 3 wherein the first additive is present in an amount of about 0.2 weight percent, and the second additive is present in an amount of about 0.1 weight percent.

36. A toner composition in accordance with claim 3 with an admix time of from about 10 to about 60 seconds.

37. A toner composition in accordance with claim 3 with an admix time of from less than about 15 seconds.

38. A toner composition in accordance with claim 3 wherein a colloidal silica is treated with the charge enhancing additive mixture.

39. A toner composition in accordance with claim 3 wherein the resin particles are comprised of styrene polymers, polyesters, or mixtures thereof.

40. A toner composition in accordance with claim 3 containing a wax component with a weight average molecular weight of from about 1,000 to about 6,000.

41. A toner composition in accordance with claim 1 wherein the alkyl ammonium bisulfate is of the formula $(R_4N)+(HSO_4)-$, wherein R is an alkyl substituent.

42. A toner composition in accordance with claim 2 wherein the alkyl ammonium bisulfate is of the formula $(R_4N)+(HSO_4)-$, wherein R is an alkyl substituent.

* * * * *